US008864353B2

(12) United States Patent
Sasaki et al.

(10) Patent No.: US 8,864,353 B2
(45) Date of Patent: Oct. 21, 2014

(54) VEHICLE POSITION LAMP AND HEADLIGHT

(75) Inventors: Yoshihiro Sasaki, Tokyo (JP); Hideki Toyoyama, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 490 days.

(21) Appl. No.: 13/358,500

(22) Filed: Jan. 25, 2012

(65) Prior Publication Data

US 2012/0188782 A1 Jul. 26, 2012

(30) Foreign Application Priority Data

Jan. 25, 2011 (JP) ..... 2011-013247

(51) Int. Cl.
*F21V 5/00* (2006.01)
*F21S 8/10* (2006.01)

(52) U.S. Cl.
CPC ..... *F21S 48/215* (2013.01); *F21S 48/2212* (2013.01)
USPC ..... 362/521

(58) Field of Classification Search
CPC ..... F21S 48/2212
USPC ..... 362/521
See application file for complete search history.

(56) References Cited

U.S. PATENT DOCUMENTS

| | | | | |
|---|---|---|---|---|
| 5,984,497 | A | 11/1999 | Foerstner et al. | |
| 6,220,736 | B1 * | 4/2001 | Dobler et al. | 362/539 |
| 7,976,203 | B2 | 7/2011 | Okada | |
| 2009/0207629 | A1 | 8/2009 | Fujiyama et al. | |

FOREIGN PATENT DOCUMENTS

| | | | |
|---|---|---|---|
| JP | 2000-123610 | A | 4/2000 |
| JP | 3181145 | B2 | 7/2001 |
| JP | 2009-193892 | A | 8/2009 |
| JP | 2010-97909 | A | 4/2010 |

OTHER PUBLICATIONS

List of Potentially Related Pending Applications citing U.S. Appl. No. 13/284,859 to Norihiro Sakamoto et al. filed Oct. 28, 2011 and U.S. Patent Application No. 13/471,678 to Teruhiko Mihara et al. filed May 15, 2012.

* cited by examiner

*Primary Examiner* — Anh Mai
*Assistant Examiner* — Hana Featherly
(74) *Attorney, Agent, or Firm* — Kenealy Vaidya LLP

(57) ABSTRACT

A vehicle position lamp can include a plurality of circuit boards each mounting an LED. The vehicle position lamp can also include a first inner lens having a plurality of optical plates and at least one connecting plate connecting between the adjacent optical plates and a second inner lens. An inner surface of each of the optical plates can be located adjacent the respective one of the circuit boards so that an optical axis of a diffusing lens of each of the optical plates corresponds to a substantially optical axis of each of the LEDs. The second inner lens can be located adjacent the first inner lens that can be formed in various slender curved shapes. Thus, the disclosed subject matter can provide vehicle position lamps having a high visibility that are formed in various slender curved shapes such that match headlights, which fit both front corners of a vehicle.

20 Claims, 14 Drawing Sheets

VEHICLE POSITION LAMP AND HEADLIGHT

This application claims the priority benefit under 35 U.S.C. §119 of Japanese Patent Application No. 2011-013247 filed on Jan. 25, 2011, which is hereby incorporated in its entirety by reference.

BACKGROUND

1. Field

The presently disclosed subject matter relates to vehicle position lamps using a plurality of LEDs and vehicle headlights using the position lamp, and more particularly to vehicle position lamps having a high visibility and a favorable light distribution, which can be incorporated into vehicle headlights along both front corners of a vehicle, and the vehicle headlights using the position lamps having a high visual quality, which can emit harmonious light with respect to each other.

2. Description of the Related Art

Various vehicle lamps incorporating a plurality of LEDs have became popular for vehicle signal lamps such as a stop lamp, a tail lamp and the like, because LEDs are battery friendly (lower power requirements), have long life, and are generally more eco-friendly, etc. in addition to emitting light having various color tones. For example, a conventional vehicle lamp using a plurality of LEDs is disclosed in Patent Document No. 1 (Japanese Patent No. 3,181,145). FIGS. 13*a* and 13*b* are a top view and a front cross-sectional view depicting the conventional vehicle lamp disclosed in Patent Document No. 1, respectively. The conventional vehicle lamp 30 can be used as a signal lamp such as a tail lamp, a stop lamp and the like, when red LEDs are used as the LEDs.

The vehicle lamp 30 includes: a base board 35 formed in a circular cup shape in which a bottom surface is formed in a circular stepped shape; a first circuit board 31 formed in a circular shape and being located on a central portion of the bottom surface of the base board 35; a second circuit board 32 formed in a ring shape and being located adjacent the first circuit board 31 on the bottom surface of the base board 35; a third circuit board 33 formed in a ring shape and being located adjacent the second circuit board 32 on the bottom surface of the base board 35; and a fourth circuit board 34 formed in a ring shape and being located adjacent the third circuit board 33 on the bottom surface of the base board 35.

In addition, the vehicle lamp 30 includes a plurality of LEDs 37 located on the first, second, third and fourth circuit boards 31-34, and an outer lens 36 formed in a dome shape and being located on a top surface of the base board 35 so that an inner surface having a prism surface of the outer lens 36 faces the plurality of LEDs 37. In this case, the bottom surface of the base board 35 is formed in the circular stepped shape so that each of distances between the inner surface of the outer lens 36 and the plurality of LEDs 37 becomes nearly equal to each other.

Accordingly, the conventional vehicle lamp 30 can efficiently emit light having a substantially uniform brightness from the outer lens 36 using the LEDs 37, even when the outer lens 36 is formed in the dome shape. The vehicle lamp 30 can form a light-emitting surface having an exemplary shape using the above-described structure so as to match various designs of vehicles.

Another conventional vehicle lamp using a plurality of LEDs is disclosed in Patent Document No. 2 (Japanese Patent Application Laid Open No. 2000-123610). FIGS. 14*a* and 14*b* are a front view and a side cross-sectional view depicting the other conventional vehicle lamp disclosed in Patent Document No. 2, respectively. The conventional vehicle lamp 40 can also be used as a signal lamp such as a tail lamp and the like because it may include a relative large light-emitting surface.

The vehicle lamp 40 includes an outer lens 41, a plurality of light-emitting boxes 43 arranged along the outer lens 41, and a housing 42 attaching the outer lens 41 and the plurality of light-emitting boxes 43 thereto. Each of the light-emitting boxes 43 includes an LED 44 located so as to emit light toward the outer lens 41, and a Fresnel lens 45 located in front of the LED 44 as shown in FIG. 14*b*.

Therefore, the other conventional vehicle lamp 40 can emit light having a uniform brightness from the outer lens 41 using a plurality of LEDs 44, even when the outer lens 41 is formed in a curve shape. The vehicle lamp 40 can also form a light-emitting surface having an exemplary shape using the above-described structure so as to match various designs of vehicles.

The above-referenced Patent Documents are listed below, and are hereby incorporated with their English abstracts in their entireties.

1. Patent Document No. 1: Japanese Patent No. 3,181,145
2. Patent Document No. 2: Japanese Patent Application Laid Open No. 2000-123610

The Patent Documents relate to the vehicle signal lamps such as a stop lamp, a tail lamp and the like, which need a relative large light-emitting surface, and the structures disclosed in the Patent Documents may be difficult to adapt a vehicle signal lamp such as a position lamp. That is because the vehicle position lamp is frequently incorporated into a lamp room that is spaced between a housing and an outer lens covering an opening of the housing, along with a high beam headlight, a low beam headlight, a turn signal lamp, etc.

In addition, in order to perform a high visibility and a high visual quality, the vehicle position lamp trends toward a lamp having a light-emitting surface that is formed in a slender curved shape such that extends along an outer lens having a curved surface of a headlight, which fits both front corners of various vehicles. Moreover, when a high intensity discharge bulb (HID bulb) and an LED light source (in which light having a blue white color tone or a white color tone may be emitted) are used as a light source for a headlight, because light emitted from vehicle position lamps using white LEDs may harmonize with the light having a substantially white color tone emitted from the headlight, the vehicle position lamps using white LEDs can result in the headlight having a high merchantability.

However, when the vehicle position lamp having the slender curved shape is designed using the structure disclosed in Patent Document No. 1, each directional quality of light emitted from the LEDs 37 degrades in a portion having a large curved surface of the outer lens and therefore, may cause a decrease of light intensity and a variation of the light intensity of the vehicle position lamp.

Moreover, when the vehicle position lamp having the slender curved shape is designed using the structure disclosed in Patent Document No. 2, each high positional accuracy between the plurality of LEDs 44 and the plurality of Fresnel lenses 45 may be required to maintain a visibility and a visual quality of the vehicle position lamp, and thus may cause a complicated work in an assembling process, an inspection process, etc.

The disclosed subject matter has been devised to consider the above and other problems, features, and characteristics. Thus, embodiments of the disclosed subject matter can include vehicle position lamps using a plurality of white LEDs which can be formed in various slender curved shapes with a simple structure such that eases a workability in manufacturing processes, and which can provide a favorable light distribution so as to be able to perform with high visibility and a high visual quality. The disclosed subject matter can also include a vehicle headlight using the position lamp, which is configured such that it is relatively easy to incorporate along with a high beam headlight, a low beam headlight and the like in a narrow space of a lamp room created between a housing and an outer lens while fitting a curved surface of the outer lens.

SUMMARY

The presently disclosed subject matter has been devised in view of the above and other problems, features, and characteristics. An aspect of the disclosed subject matter includes providing vehicle headlights using a position lamp which can be formed in various slender curved shapes such that they fit both front corners of a vehicle, and which can easily incorporate a low beam headlight, a high beam headlight and the like because the position lamp can have a slender shape such that can be incorporated into a narrow space in a lamp room. The vehicle headlights can also emit a harmonious light with light emitted from the headlights from the position lamp using white LEDs.

According to an aspect of the disclosed subject matter, a vehicle position lamp can include: a plurality of circuit boards; a plurality of white LEDs each having an optical axis and each of the white LEDs mounted on a respective one of mounting surfaces of the circuit boards; and at least one first inner lens having a plurality of optical plates and at least one connecting plate connecting between the adjacent optical plates, the optical plates each having an outer surface and an inner surface and each including a diffusing lens, an outer surface of the at least one connecting plate located toward the outer surface of one of the adjacent optical plates and exposing the diffusing lens from the one of the adjacent optical plates in a direction thereof, an inner surface of the at least one connecting plate located toward the inner surface of another one of the adjacent optical plates and exposing the diffusing lens from the other one of the adjacent optical plates in a direction thereof, and the inner surface of each of the optical plates being located adjacent the respective one of the mounting surfaces of the circuit boards so that an optical axis of the diffusing lens of each of the optical plates corresponds to the substantially optical axis of each of the white LEDs, wherein the optical axis of the diffusing lens of each of the optical plates of the at least one first inner lens is located on a substantially same virtual surface.

Additionally, the vehicle position lamp can also include a second inner lens being located adjacent the at least one first inner lens so that an inner surface thereof faces both the diffusing lens of each of the optical plates and the outer surface of the at least one connecting plate of the at least one first inner lens, intersecting with the optical axis of the diffusing lens of each of the optical plates of the at least one first inner lens, and an outer surface thereof including a plurality of linear prisms, which extend along the substantially same virtual surface, and a casing located adjacent the circuit boards so as to cover the at least one first inner lens along with the second inner lens, and wherein the at least one first inner lens integrates the at least one connecting plate into the plurality of optical plates as an all-in-one package.

In the above-described exemplary vehicle position lamp, the at least one connecting plate can be configured to receive a part of light from the inner surface of the one of the adjacent optical plates, and also the inner surface thereof can include a concave surface toward the outer surface thereof in order to efficiently emit light from the at least one connecting plate toward the second inner lens. In addition, the inner surface of each of the optical plates can include a plurality of linear prisms that extend at least one of in a direction parallel to the substantially same virtual surface and in a direction perpendicular to the substantially same virtual surface so as to efficiently emit a diffusing light from the diffusing lens in accordance with a shape of the second inner lens. The mounting surface and the rear surface of each of the circuit boards can include a metallic foil to prevent each of the LEDs from a positional misalignment due a heat.

Moreover, in the above-described exemplary vehicle position lamp, the at least one connecting plate includes a plurality of connecting plates each having a length between the adjacent optical plates, wherein the length of each of the connecting plates is configured to become gradually short in the light-emitting direction of each of the white LEDs, so that the vehicle position lamp can provide a favorable light distribution along the outer lens having various curved shapes. The vehicle position lamp can further include at least one fixing seat located adjacent the inner surface of each of the optical plates and at least two stays included in the second inner lens, in order to ease a workability for fixing the circuit boards and for an assembly thereof.

According to the above-described exemplary vehicle headlight, because the diffusing lens of each of the optical plates of the at least one first inner lens that can be formed in various slender curved shapes so as to match the shape of the second inner lens can be arranged along the second inner lens, the vehicle position lamp can provide light having a high visibility. In addition, because light can also be emitted from the at least one connecting plate connecting the optical plates, the vehicle position lamp can provide light having a high visual quality using the at least one first inner lens. Moreover, because the at least one first inner lens can be integrated as an all-in-one package, the optical axis of the diffusing lens of each of the optical plates of the at least one first inner lens may easily correspond to the optical axis of each of the white LEDs. Thus, the disclosed subject matter can provide vehicle position lamps having a favorable light distribution with a simple structure, such that can ease a workability in the manufacturing processes and can reduce a positional misalignment between the optical axes.

Another aspect of the disclosed subject matter includes a vehicle headlight using the position lamp such that fits both front corners of a vehicle. The vehicle headlight can include a structure described above, and can further include: a housing having an opening; an outer lens having an edge portion, and the edge portion of the outer lens located adjacent an edge portion of the opening of the housing; a lamp room spaced between the housing and the outer lens, and the lamp room incorporating the vehicle position lamp so that the second inner lens of the vehicle position lamp faces the outer lens; and at least one of a low beam headlight having a light-emitting direction, a high beam headlight having a light-emitting direction and a turn signal lamp having a light-emitting direction located in the lamp room along with the vehicle position lamp, wherein each of the light-emitting directions of the low beam headlight, the high beam headlight and the turn signal lamp is directed toward the outer lens.

In this case, each of a low beam light source of the low beam headlight and a high beam light source of the high beam headlight can be at least one of an HID bulb and a white LED light source. In addition, the same or similar variations of the vehicle position lamp can also be employed as described above.

According to an exemplary vehicle headlight, because the vehicle position lamp can be formed in various slender curved shapes such that is easily incorporated into a narrow space in the lamp room between the curved outer lens and the housing, which matches both front corners of a vehicle. Thus, the vehicle headlight can functionally incorporate the low beam headlight, the high beam headlight and the like along with the position lamp with a simple structure such that can ease a workability. Furthermore, the vehicle position lamp using the white LEDs can emit light having a substantially white color tone that is formed in various slender curved shapes. Thus, the disclosed subject matter can provide vehicle headlights having a high merchantability and a high visual quality, which can emit harmonious light having a substantially same white color tone from the position lamp and the headlights having a light source such as the HID bulb and the white LED light source.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
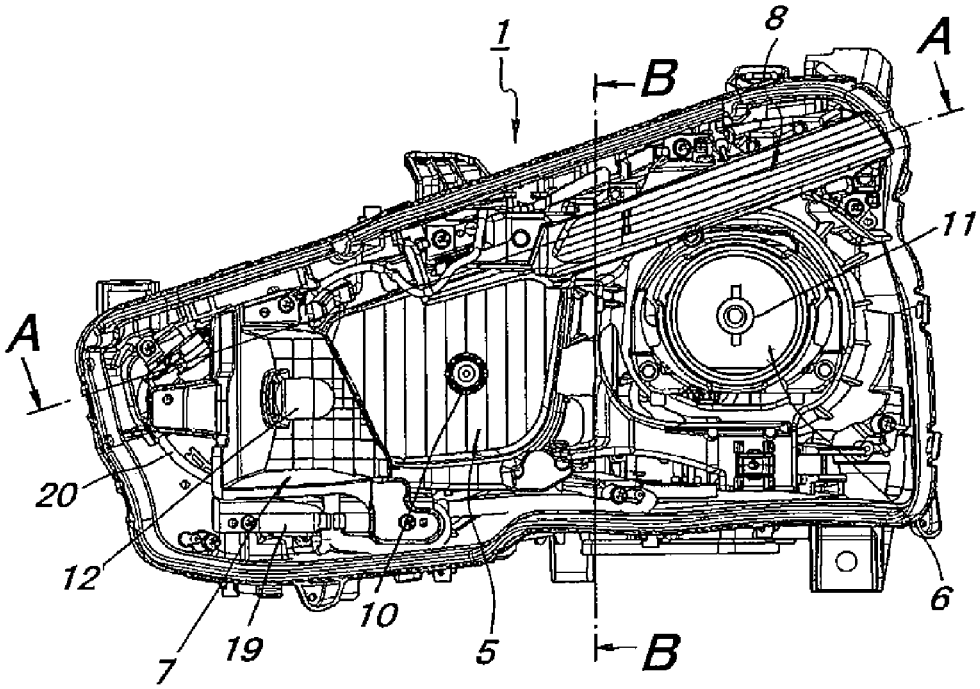
FIG. 1 is a front view showing an exemplary embodiment of a vehicle headlight made in accordance with principles of the disclosed subject matter.

Exemplary embodiments of the disclosed subject matter will now be described in detail with reference to FIGS. 1 to 12. FIG. 1 is a front view showing an exemplary embodiment of a vehicle headlight made in accordance with principles of the disclosed subject matter, wherein a housing and an outer lens are not shown in FIG. 1 in order to facilitate a clear understanding of the disclosed subject matter.

A vehicle headlight 1 shown in FIG. 1 can be attached to a left front corner of a vehicle in a front view from the vehicle, and another vehicle headlight that is symmetrical to the vehicle headlight 1 can be attached to a right front corner of the vehicle. Accordingly, the vehicle headlight 1 will be described in the embodiment, and descriptions of the other vehicle headlight are abbreviated.

The vehicle headlight 1 can include: a high beam headlight 5 provided with a high beam light source 10 and being located in a middle portion thereof; a low beam headlight 6 provided with a low beam light source 11 and being located adjacent the high beam headlight 5; a turn signal lamp 7 including a bulb 12 and being located adjacent the high beam headlight 5 so that the high beam headlight 5 is located between the low beam headlight 6 and the turn signal lamp 7; a position lamp 8 provided with a plurality of LEDs as a light source, formed in a slender shape and being located above the low beam headlight 6; an LED driving circuit 19 driving the LEDs and being located under the turn signal lamp 7; and a power cord 20 connecting between the LEDs and the LED driving circuit 19.

As the high beam light source 10 and the low beam light source 11, an incandescent lamp, a halogen bulb, an HID bulb and a white LED can be used for the high beam headlight 5 and the low beam headlight 6, respectively. Especially, the HID bulb and the white LED may match white light emitted from the position lamp 8 using white LEDs because they can emit light having a substantially white color tone. The white LED used for the high beam headlight 5 and the low beam headlight 6 will be described in detail later, along with the white LEDs used for the position lamp 8. As the bulb 12 of the turn signal lamp 7, an incandescent lamp, an amber LED and the like can be used so that the turn signal lamp 7 can emit amber light such that conforms to a vehicle lamp standard for a turn signal lamp.

The turn signal lamp 7 hardly generates a high heat as compared with the high beam headlight 5 and the low beam headlight 6, because it rarely turns on and a rating power of the bulb 12 thereof may be relatively low. Accordingly, the LED driving circuit 19 can drive the LEDs of the position lamp 8 in stable condition by locating it under the turn signal lamp 7

Figure 2:
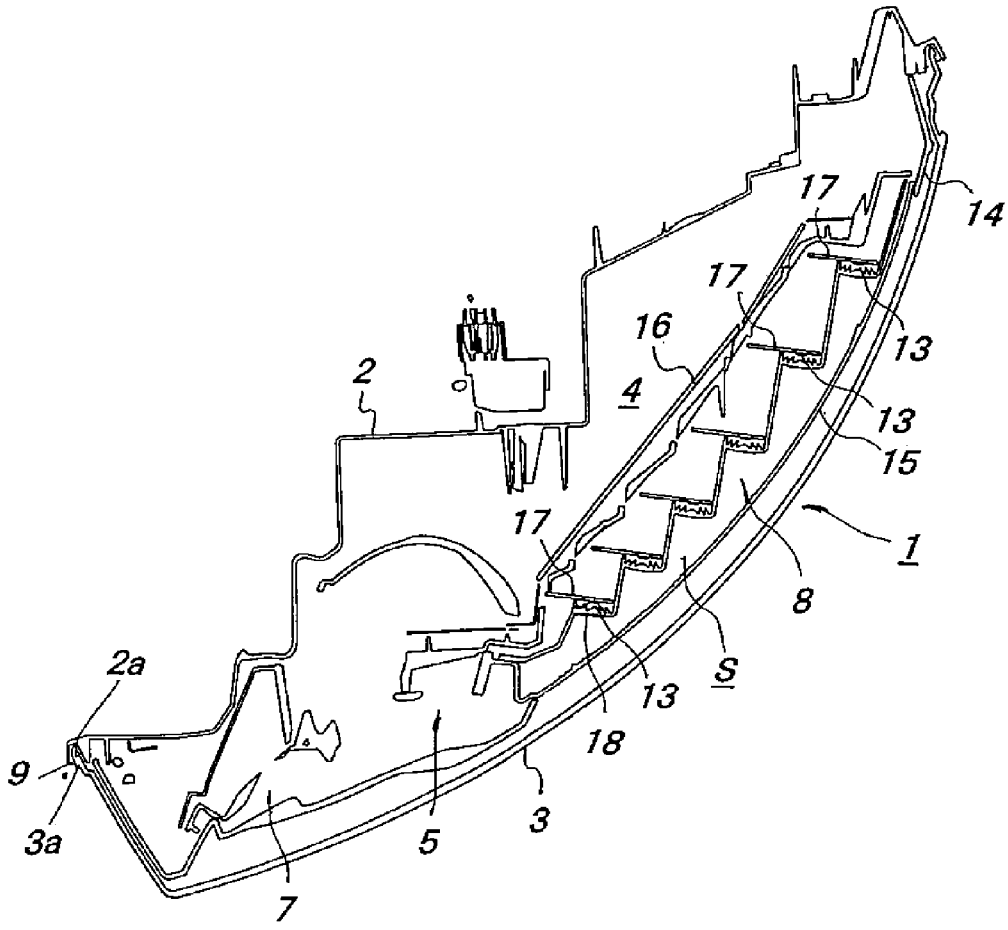
FIG. 2 is a cross-sectional view showing a cross-section taken along line A-A of the embodiment of the vehicle headlight shown in FIG. 1.

FIG. 2 is a cross-sectional view showing a cross-section taken along line A-A of the embodiment of the vehicle headlight 1 shown in FIG. 1. The vehicle headlight 1 can also include: the housing 2 having an opening that is made by casting a resin, and the housing 2 provided with a fixing concave 2*a* at an edge portion of the opening thereof; the outer lens 3 made by casting a transparent resin and including a fixing convex 3*a* at an edge portion thereof so as to be able to receive the fixing concave 2*a* of the housing 2; and a lamp room 4 being spaced between the housing 2 and the outer lens 3 by attaching the fixing concave 2*a* of the housing 2 to the fixing convex 3*a* of the outer lens 3 using a hot melt 9, and the lamp room 4 incorporating the above-described high beam headlight 5, the turn signal lamp 7, the position lamp 8, etc.

The position lamp 8 can include: a second inner lens 15 having an inner surface and an outer surface, made of a transparent resin and formed in a slender curved shape, and the second inner lens 15 located along the outer lens 3 so that the outer surface thereof is located in substantially parallel with an inner surface of the outer lens 3 and extending above the low beam headlight 6; and a casing 16 located between the second inner lens 15 and the housing 2 and extending along the second inner lens 15 so that a lamp space S is spaced between the casing 16 and the second inner lens 15.

Additionally, the position lamp 8 can also include: a plurality of circuit boards 17 each having a mounting surface and a rear surface, and located in the lamp space S; each of the plurality of LEDs 13 mounted on a respective one of the mounting surfaces of the circuit boards 17; and a first inner lens 18 made by a transparent resin and extending between the casing 16 and the second inner lens 15 so as to cover each of the LEDs 13 along with the plurality of circuit boards 17. In this case, a panel 14 can be located between the second inner lens 15 of the position lamp 14 and the outer lens 3 and can be located along the low beam headlight 6 in order to improve a visual quality and the like.

Figure 3:
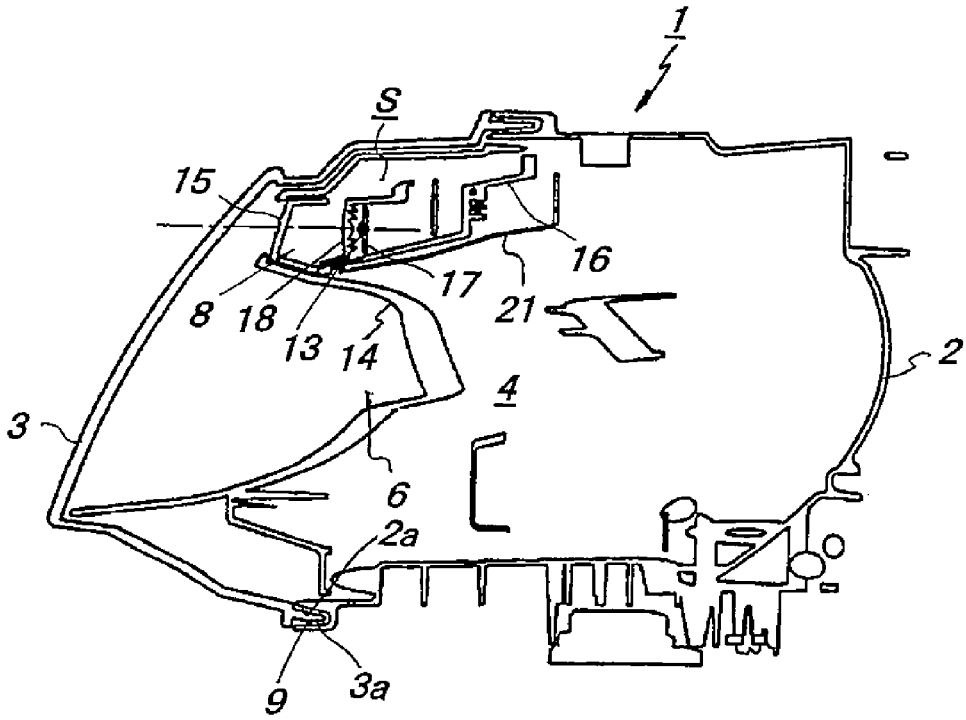
FIG. 3 is a cross-sectional view showing a cross-section taken along line B-B of the embodiment of the vehicle headlight shown in FIG. 1.

FIG. 3 is a cross-sectional view showing a cross-section taken along line B-B of the embodiment of the vehicle headlight 1 shown in FIG. 1. A heat shield plate 21 can be located between the position lamp 8 and the low beam headlight 6 so as to be spaced between the heat shield plate 21 and both the position lamp 8 and the low beam headlight 6. The heat shield plate 21 can be made of a plate having a thermal resistance such as a metallic plate, a resin plate, etc. The heat shield plate 21 can efficiently radiate heat generated from the position lamp 8 and the low beam headlight 6 from the lamp space S and the lamp room 4.

Figure 4:
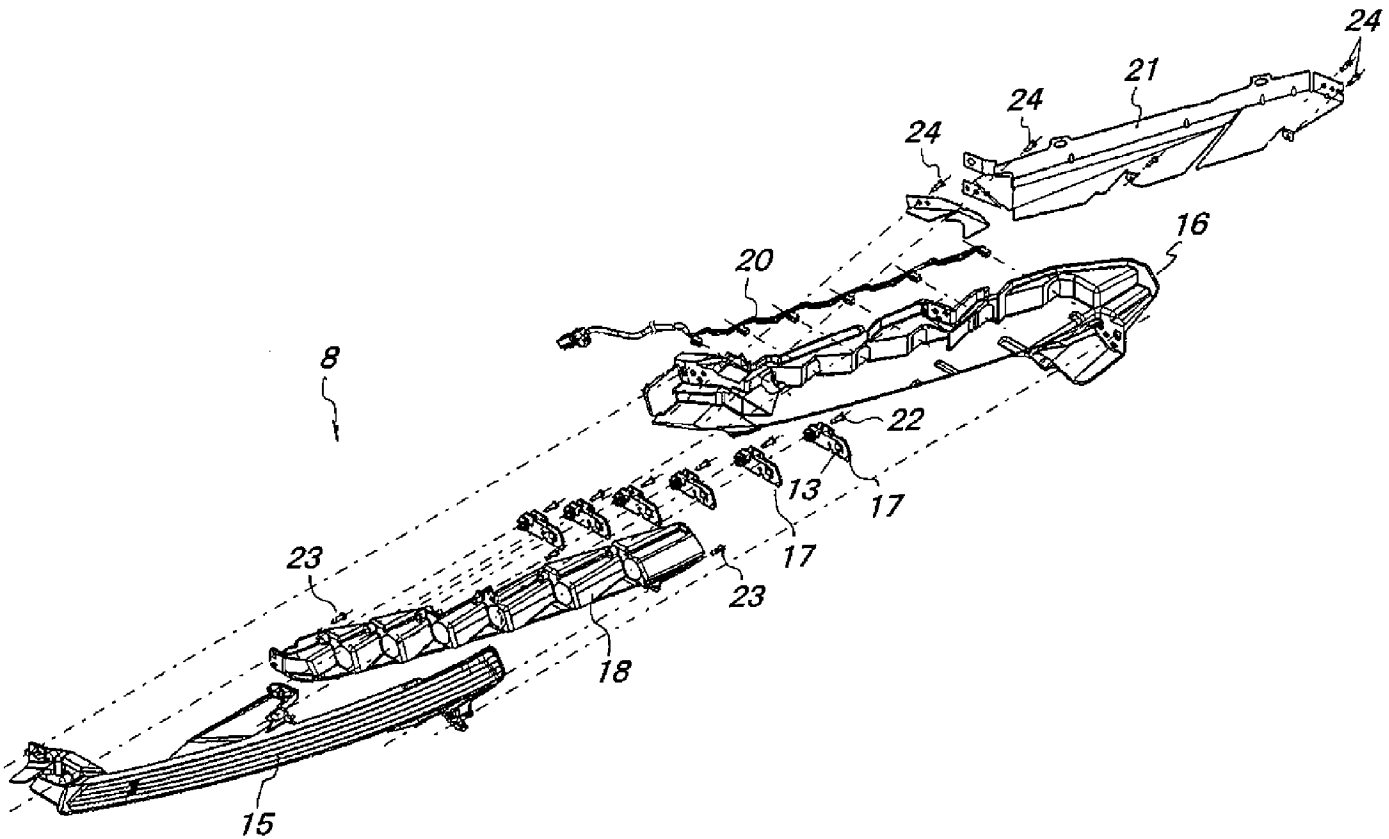
FIG. 4 is an exploded perspective view showing an exemplary embodiment of a vehicle position lamp made in accordance with principles of the disclosed subject matter.

Structures of the position lamp 8 will now be described in detail. FIG. 4 is an exploded perspective view showing an exemplary embodiment of a vehicle position lamp made in accordance with principles of the disclosed subject matter. The respective one of the mounting surfaces of the circuit boards 17 that mounts each of the LEDs 13 thereon can be attached to the first inner lens 18 as described in detail later via screws 22. The first inner lens 18 can be attached to the second inner lens 15 along with the circuit boards 17 via screws 23.

In addition, the heat shield plate 21 can be attached to the housing 16 via screws 24, and also the housing 16 can be attached to the second inner lens 15 along with the heat shield plate 21 via the screws 24. The power cord 20 can be electrically connected to each of the circuit boards 17 that is exposed from the housing 16, via connectors, solder and the like so that the LED driving circuit 19 provides each of the LEDs 13 with an appropriate current.

Figure 5:
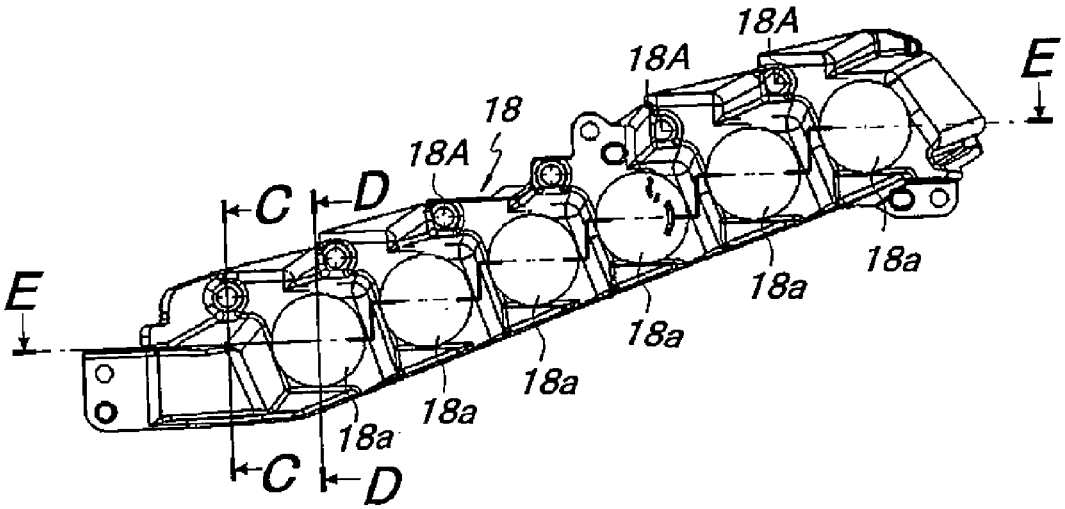
FIG. 5 is a perspective view showing an assembly of a first inner lens and a plurality of circuit boards in the embodiment of the vehicle position lamp shown in FIG. 4.

FIG. 5 is a perspective view showing an assembly of the first inner lens 18 and the plurality of circuit boards 17 in the embodiment shown in FIG. 4. Structures of the first inner lens 18 will now be described with reference to FIG. 5 and cross-sectional views taken along lines C-C, D-D and E-E shown in FIG. 5. The first inner lens 18 can be provided with a plurality of optical plates and at least one connecting plate connecting between the adjacent optical plates, and each of the optical plates can include a diffusing lens 18*a* having an optical axis such as a circular convex lens having an optical axis, which is located at a center of the diffusing lens 18*a*.

Figure 6:
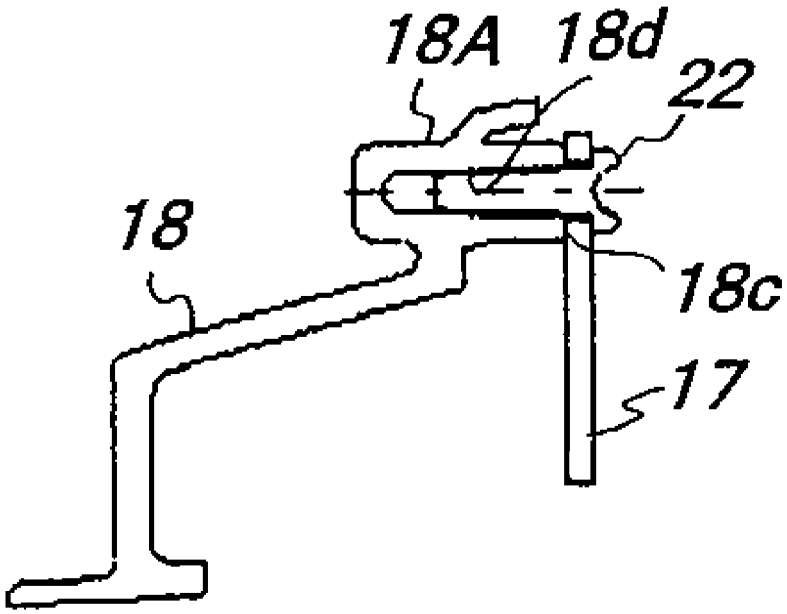
FIG. 6 is a cross-sectional view showing a cross-section taken along line C-C of the assembly of the first inner lens and the plurality of circuit boards shown in FIG. 5.
Figure 7:
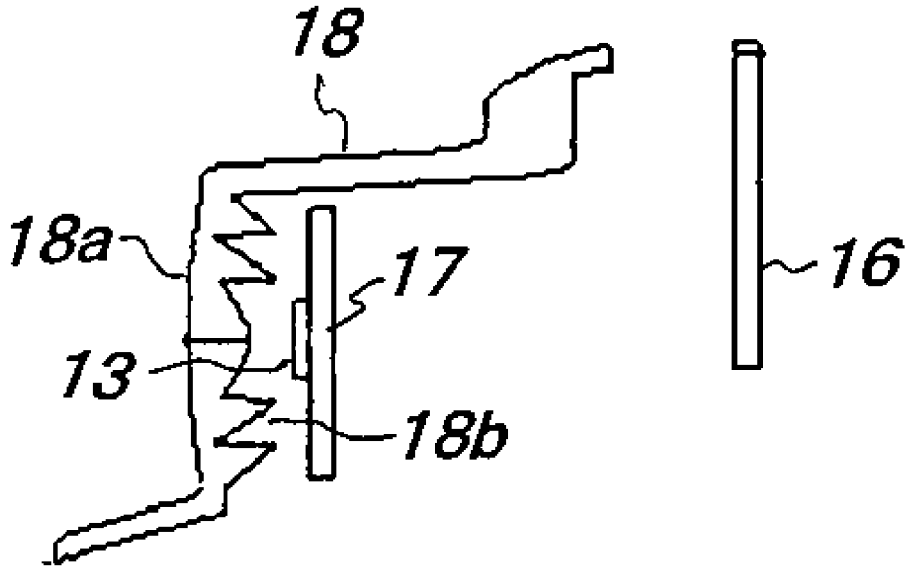
FIG. 7 is a cross-sectional view showing a cross-section taken along line D-D of the assembly of the first inner lens and the plurality of circuit boards shown in FIG. 5.

FIGS. 6 and 7 are cross-sectional views showing cross-sections taken along lines C-C and D-D, respectively, of the assembly of the first inner lens 18 and the plurality of circuit boards 17 shown in FIG. 5. Each of the optical plates of the first inner lens 18 can be provided with at least one boss 18A, which includes a screw hole 18*d* therein and a fixing seat 18*c* on an inner surface thereof for attaching the respective one of the circuit boards 17 to an inner surface of each of the optical plates of the first inner lens 18.

Accordingly, the respective one of the circuit boards 17 can be attached to the fixing seat 18*c* of each of the optical plates of the first inner lens 18 using the boss 18A including the screw hole 18*d* and the screw 22 as shown in FIG. 6. In this case, each of the LEDs 13 can be located toward the diffusing lens 18*a* of each of the optical plates of the first inner lens 18 so that the optical axis of the diffusing lens 18*a* corresponds substantially to the optical axis (not shown in FIG. 7) of each of the LEDs 13. Moreover, the optical axis of the diffusing lens 18*a* of each of the optical plates of the first inner lens 18 can be located on substantially the same virtual surface in order to adapt the optical axis of each of the LEDs 13.

On the inner surface of each of the optical plates of the first inner lens 18 that faces each of the LEDs 13, a prism 18*b* can be formed to enter light emitted from each of the LEDs 13 into the diffusing lens 18*a* while diffusing the light therewith. The prism 18*b* can be formed, for example, in a plurality of linear shapes which extend in at least one of a direction parallel to the substantially same virtual surface including the optical axis of the diffusing lens of each of the optical plates of the first inner lens 18 and a direction perpendicular to the substantially same virtual surface, in accordance with shapes of the second inner lens 15 and the first inner lens 18.

Figure 8:
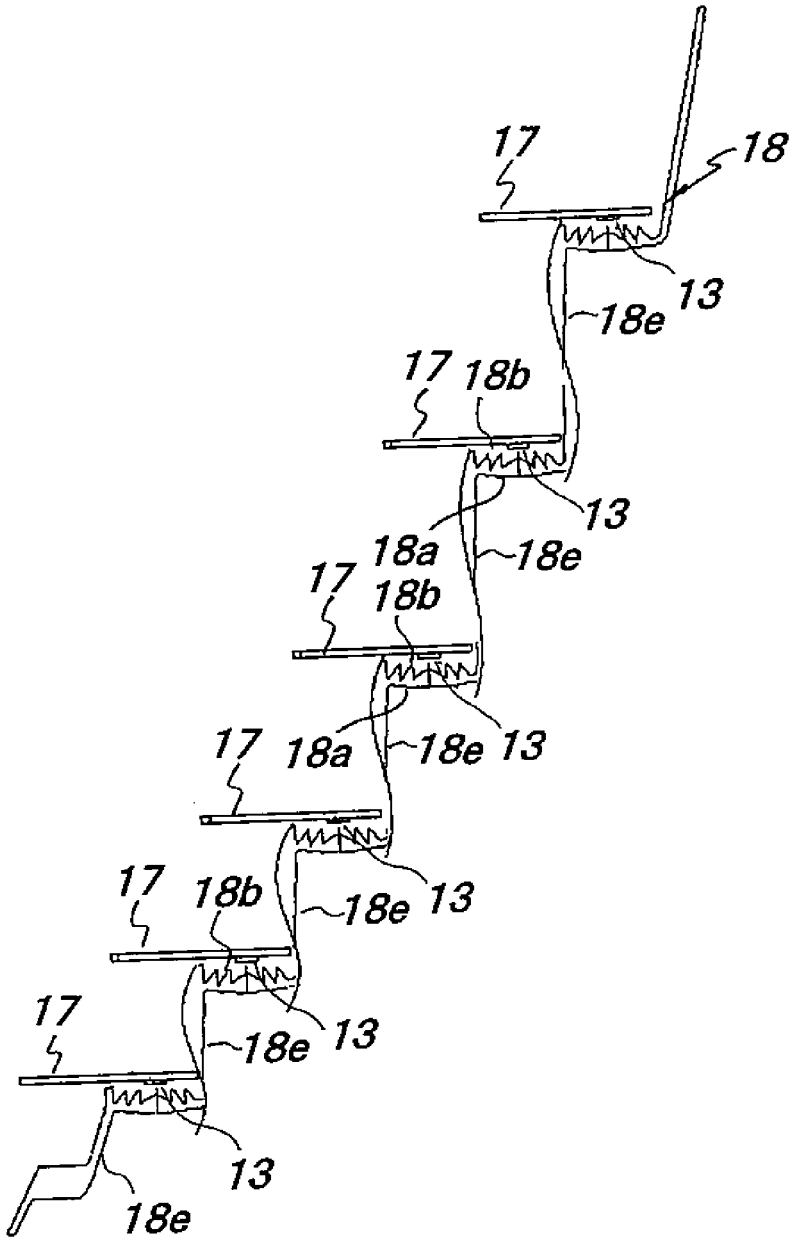
FIG. 8 is a cross-sectional view showing a cross-section taken along line E-E of the assembly of the first inner lens and the plurality of circuit boards shown in FIG. 5.

FIG. 8 is a cross-sectional view showing a cross-section taken along line E-E of the assembly of the first inner lens 18 and the plurality of circuit boards 17 shown in FIG. 5. Each of the plurality of optical plates of the first inner lens 18 can be connected between the adjacent optical plates by the at least one connecting plate 18*e*. In this case, an outer surface of the at least one connecting plate 18*e* that faces the inner surface of the second inner lens 15 can be located toward an outer surface of one of the adjacent optical plates while exposing the diffusing lens 18*a* from the one of the adjacent optical plates in a direction toward the outer surface of the at least one connecting plate 18*e*. An inner surface of the at least one connecting plate 18*e* can be located toward the inner surface of another one of the adjacent optical plates while exposing the diffusing lens 18*a* from the other one of the adjacent optical plates in a direction toward the inner surface of the at least one connecting plate 18*e*.

The at least one connecting plate 18*e* can also be used as a light guide, which guides a part of the light emitted from the one of the adjacent optical plates of the first inner lens 15. Accordingly, light guided between the adjacent optical plates can be emitted toward the second inner lens 15 from the outer surface of the at least one connecting plate 18*e* by forming the inner surface of the at least one connecting plate 18*e* in a concave shape toward the outer surface of the at least one connecting plate 18*e*. Thereby, a light intensity of light emitted from the first inner lens 18 can be enhanced.

In addition, the first outer lens 18 can integrate the at least one connecting plate 18*e* into the plurality of optical plates by casting them with a transparent resin such as polycarbonate, etc. Thereby, positional accuracies between the optical axis of each of the LEDs 13 and the optical axis of the diffusing lens 18*a* of each of the optical plates of the first inner lens 18 and between the adjacent optical plates of the first inner lens 18 can improve, and also a fixing process of the first inner lens 18 and the plurality of circuit boards 17 can be reduced. Thus, the integration of the first inner lens 18 can result in a high light-emitting accuracy of the position lamp 8 and an improvement of workability.

As shown in FIG. 7, because the plurality of circuit boards 17 that mounts each of the LEDs 13 on the respective one of the mounting surfaces thereof is located between the first inner lens 18 and the housing 16, the circuit boards 17 may be subject to a relative high heat. However, the plurality of circuit boards 17 can be divided into a respective one having a small size, and the respective one of the circuit boards 17 can be attached to each of the optical plates of the first inner lens 18. Accordingly, a positional misalignment between the optical axis of each of the LEDs 13 and the optical axis of the diffusing lens 18*a* of the optical plates of the first inner lens 18, which is caused by a difference between thermal expansion coefficients of the circuit boards 17 and the first inner lens 18, can be reduced.

However, both the mounting surface and the rear surface of the circuit boards 17 can be coated with a metallic foil such as a copper foil, etc. In this case, because the both surfaces of the circuit boards 17 are coated with the same metallic foil having substantially the same thermal expansion coefficient, even when the circuit boards 17 receive a high heat from each of the LEDs 13, each deformation of the circuit boards 17 can be prevented due to the same thermal expansion coefficient. Thus, the positional misalignment between the optical axis of each of the LEDs 13 and the optical axis of the diffusing lens 18*a* of each of the optical plates of the first inner lens 18 can be mostly or completely avoided.

A white LED can be used as each of the LEDs 13 mounted on the respect one of the circuit boards 17 for the position lamp 8 as well as the high beam light source 10 and the low beam light source 11. The white LED can include a blue LED chip having a peak wavelength of 460 nanometers and a yellow phosphor, which can emit a yellow light by exciting it with blue light emitted from the blue LED chip. In this case, the white LED can emit substantially white light by an additive color mixture of the excited yellow light emitted from the yellow phosphor and a part of the blue light emitted from the blue LED chip.

As the yellow phosphor, $Y_3Al_5O_{12}:Ce^{3+}$ (YAG) and the like can be used. In place of the yellow phosphor, a red phosphor (e.g., $CaAlSiN_3:Eu^{2+}$, $Ca_2Si_5N_8:Eu^{2+}$) wavelength-converting the blue light emitted from the blue LED chips into red-purple light and a green phosphor (e.g., $Y_3(Ga, Al)_5O_{12}:Ce^{3+}$, $Ca_3Sc_2Si_3O_{12}:Ce^{3+}$) wavelength-converting the blue light into blue-green light can also be used. In this case, light having a substantially white color tone can be emitted by an additive color mixture of the red-purple light that is excited by the blue light, the blue-green light emitted from the green phosphor and a part of the blue light.

An LED of InGaN series that emits near-ultraviolet light having a wavelength of approximately 380 nanometers, a laser diode that emits ultraviolet light and the like can also be used in place of the blue LED chip. In this case, in order to emit the substantially white light, a wavelength converting material can include: a red phosphor (e.g., $La_2O_2S: Eu^{3+}$, $KSiF_6: Mn^{4+}$) wavelength-converting the ultraviolet light into red light; a green phosphor (e.g., $(Si, Al)_6 (O, N):Eu^{2+}$, $BaMgAl_{10}O_{17}: Eu^{2+}Mn^{2+}$) wavelength-converting the ultraviolet light into green light; and a blue phosphor (e.g., $(Sr, Ca, Ba, Mg)_{10}(PO_4)_6C_{12}:Eu^{2+}$, $BaMgAl_{10}O_{17}: Eu^{2+}$) wavelength-converting the ultraviolet light into blue light.

Thereby, the position lamp 8 can emit light having a substantially white color tone, and therefore the light emitted from the position lamp 8 can harmonize with light emitted from the high beam headlight 5 and the low beam headlight 6. In addition, when the optical plates of the first inner lens 18 are connected by a plurality of the connecting plates 18*e*, each length in a connecting direction of the plurality of the connecting plates 18*e* can gradually shorten in an outside direction of the vehicle headlight (toward the high beam headlight 5 in FIG. 2) in order to enhance the visibility of a position lamp to other vehicles, pedestrians, etc.

Furthermore, the above-described substantially same virtual surface including the optical axis of the diffusing lens of each of the optical plates of the first inner lens 18 can be located at an approximately center line of the second inner lens 15 such that it divides the second inner lens 15 into two pieces up and down in the extending direction of the second inner lens 15. In this case, the vehicle position lamp 8 can provide more favorable light distribution using light emitted from each of LEDs 13 via the first inner lens 18 and the second inner lens 15.

Figure 9:
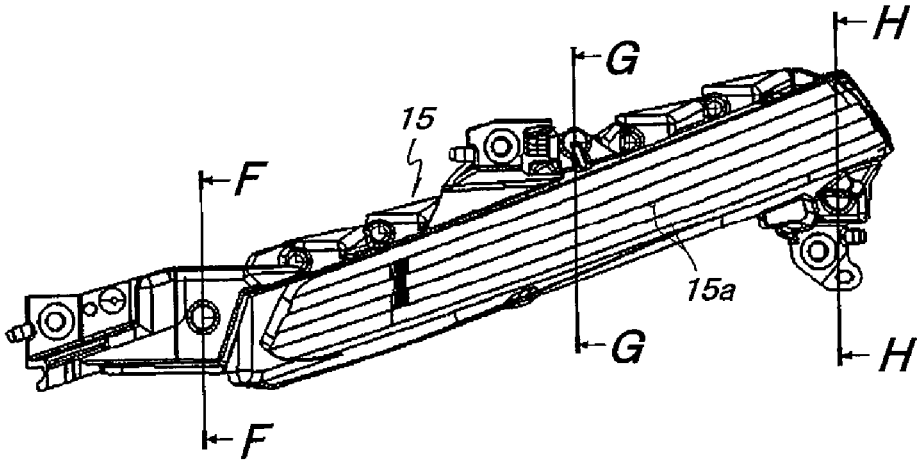
FIG. 9 is a perspective view showing an embodiment of the vehicle position lamp made in accordance with principles of the disclosed subject matter.

FIG. 9 is a perspective view showing an embodiment of the vehicle position lamp 8 made in accordance with principles of the disclosed subject matter. An exemplary method for attaching the first inner lens 18 to the second inner lens 15 will now be described with reference to FIG. 9 and cross-sectional views taken along lines F-F, G-G and H-H shown in FIG. 9.

Figure 10:
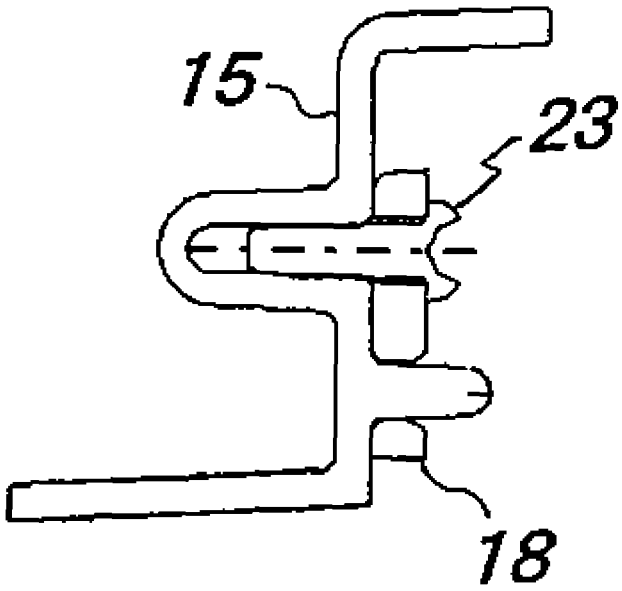
FIG. 10 is a cross-sectional view showing a cross-section taken along line F-F of the embodiment of the vehicle position lamp shown in FIG. 9.
Figure 11:
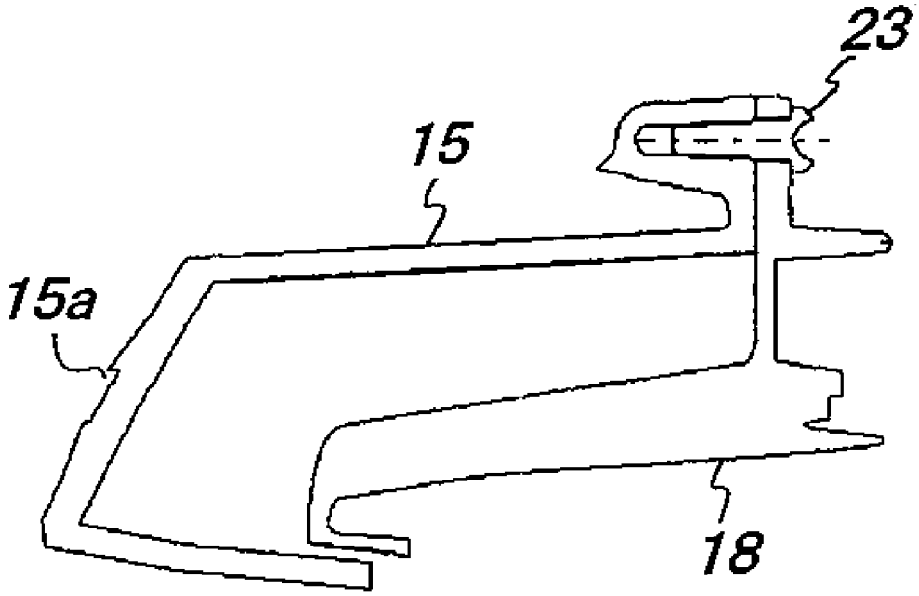
FIG. 11 is a cross-sectional view showing a cross-section taken along line G-G of the embodiment of the vehicle position lamp shown in FIG. 9.

The second inner lens 15 can include a first stay that bends in the opposite direction of the outer lens 3 at an edge portion located in the outer direction of the vehicle headlight 1. FIG. 10 is a cross-sectional view showing a cross-section taken along line F-F of the embodiment shown in FIG. 9. The first inner lens 18 can be attached to the first stay of the second inner lens 18 at an edge portion thereof via the screw 23. The second inner lens 15 can also include a second stay that projects in an upward direction of the second inner lens 15 at a middle portion of the second inner lens 15. FIG. 11 is a cross-sectional view showing a cross-section taken along line G-G of the embodiment shown in FIG. 9. The first inner lens 15 can be attached to the second stay of the second inner lens 18 at a middle portion thereof via the screw 23.

Figure 12:
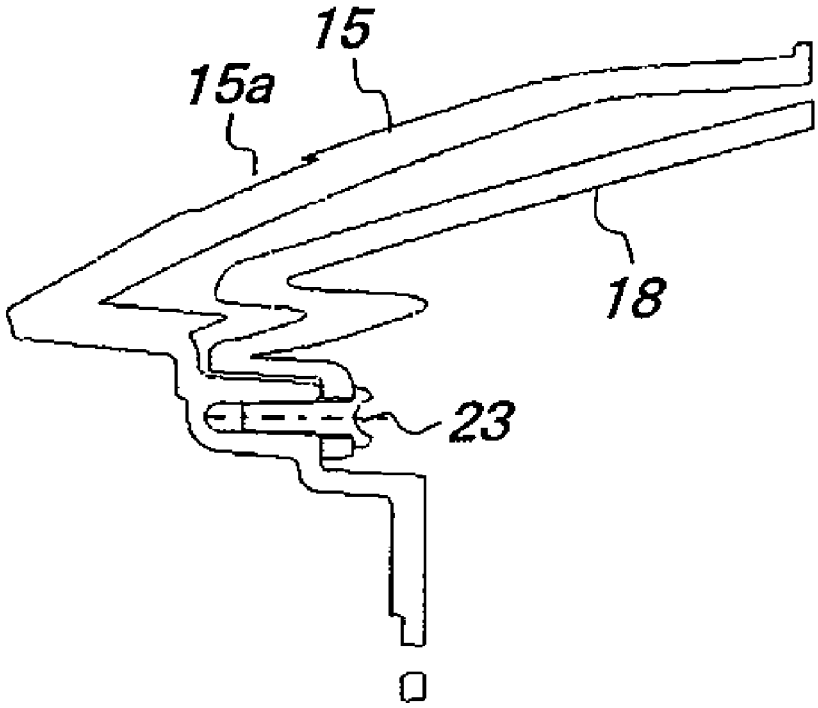
FIG. 12 is a cross-sectional view showing a cross-section taken along line H-H of the embodiment of the vehicle position lamp shown in FIG. 9
Figure 13A:
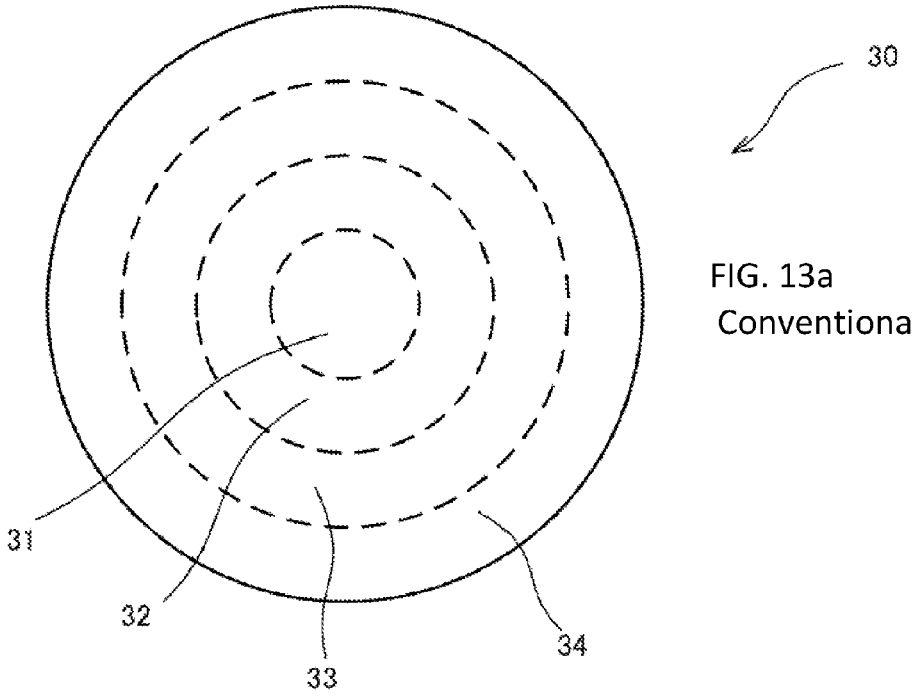
FIG. 13a Conventional Art
FIGS. 13*a* and 13*b* are a top view and a front cross-sectional view depicting a conventional vehicle lamp using a plurality of LEDs, respectively.
Figure 13B:
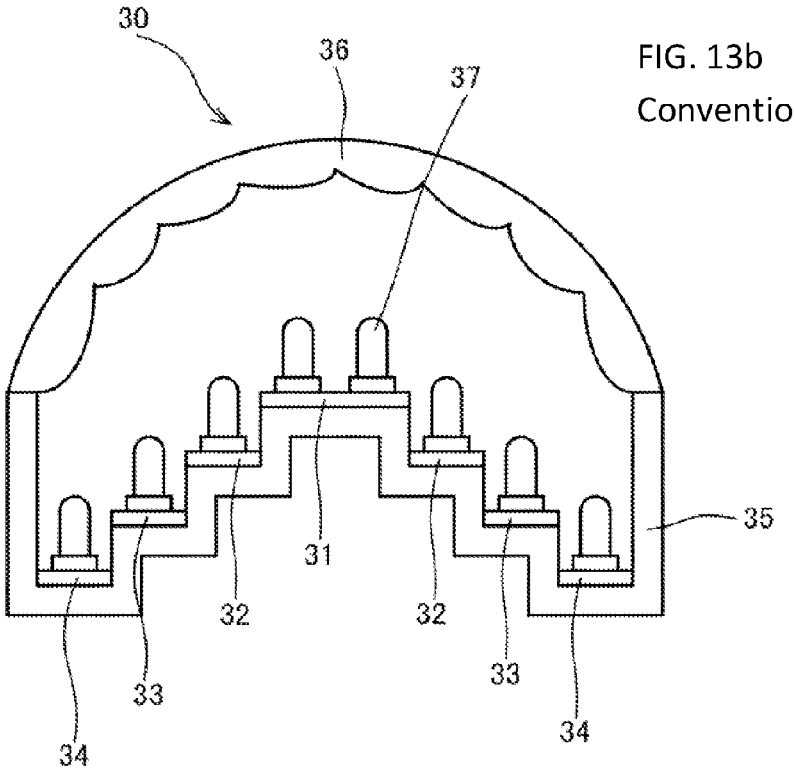
FIG. 13b Conventional Art
Figure 14A:
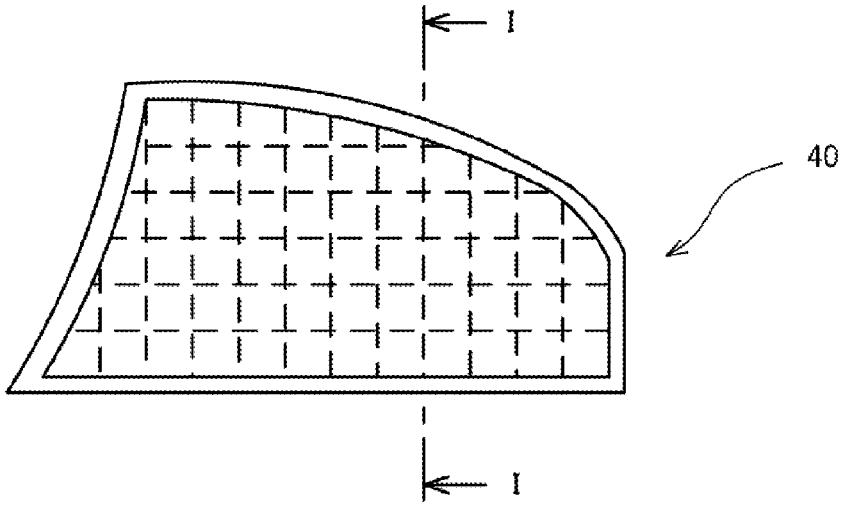
FIG. 14a Conventional Art
FIGS. 14*a* and 14*b* are a front view and a side cross-sectional view depicting another conventional vehicle lamp using a plurality of LEDs, respectively.
Figure 14B:
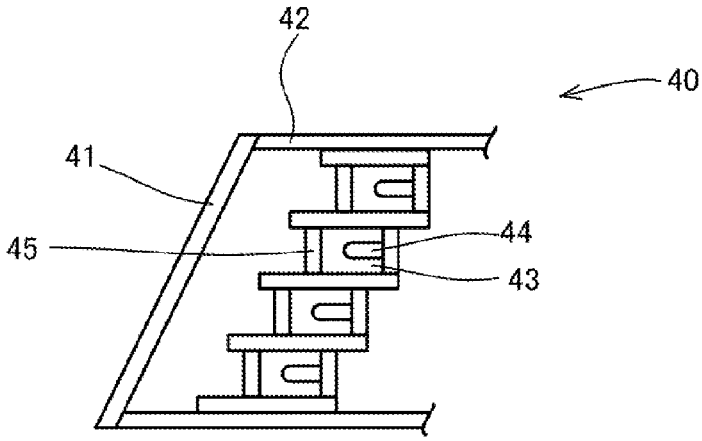
FIG. 14b Conventional Art

In addition, the second inner lens 15 can include a third stay that projects in a downward direction of the second inner lens 15 at another edge portion located in an inner direction of the vehicle headlight 1. FIG. 12 is a cross-sectional view showing a cross-section taken along line H-H of the embodiment shown in FIG. 9. The first inner lens 18 can be attached to the third stay of the second inner lens 18 at another edge portion thereof via the screw 23.

Thereby, the first inner lens 18 can be attached to the second inner lens 15 with confidence, even when the first inner lens 18 is relatively long in the extending direction of the second inner lens 15. However, the first inner lens 18 can be divided into a plurality of inner lenses when it is advantageous or desired to form it in a very long shape. For example, when the first inner lens 18 is composed of two pieces, the two pieces can be connected at the second stay of the second inner lens 15 and can be operated as the above-described first inner lens 18.

The second inner lens 15 can be provided with a plurality of prism lines 15*a* on an outer surface thereof as shown in FIG. 9. The plurality of prism lines 15*a* can extend in the extending direction of the second inner lens 15 in order to form a prescribed light distribution using light emitted from the first inner lens 18 for the position lamp 8. In the case, the plurality of prism lines 15*a* can extend in parallel with the substantially same virtual surface including the optical axis of the diffusing lens of each of the optical plates of the first inner lens 18 to further efficiently emit the light having a prescribed light distribution.

As described above, the first inner lens 18 can be formed in various slender curved shapes so as to fit various shapes of the second inner lens 15, and also the diffusing lens 18*a* of each of the optical plates of the first inner lens 18 can be arranged in various positions along the extending direction of the second inner lens 15. Accordingly, the vehicle position lamp 8 can provide light having a high visibility, which is formed in various slender curved shapes along both front corners of a vehicle. In addition, because light can also be emitted from the connecting plate 18*e* connecting the adjacent optical plates of the first inner lens 18, the white LEDs 13 can emit light having a substantially white color tone from the whole first inner lens 18. Thus, the disclosed subject matter can provide vehicle position lamps having a high visibility and a high visual quality.

Moreover, because the first inner lens 18 can integrate the at least one connecting plate 18*e* into the plurality of optical plates as an all-in-one package, the optical axis of the diffusing lens 18*a* of each of the optical plates of the first inner lens 18 may easily correspond to the optical axis of each of the white LEDs 13. Thus, the disclosed subject matter can provide vehicle position lamps have a favorable light distribution with a simple structure, such that can ease the workability and such that can reduce the positional misalignment between the optical axis of the diffusing lens 18*a* of each of the optical plates and the optical axis of each of the white LEDs 13.

Furthermore, the vehicle headlight 1 using the position lamp 8 can easily incorporate the low beam headlight 8, the high beam headlight 5 and the like along with the position lamp 8 with a simple structure, because the vehicle position lamp 8 can be formed in various slender curved shapes such that is easily incorporated into a narrow space in the lamp room 4. The vehicle position lamp 8 using the white LEDs 13 can emit light having a substantially white color tone that is formed in various slender curved shapes. Thus, the disclosed subject matter can provide vehicle headlights having a high merchantability and a high visual quality, which can emit harmonious light having a substantially same white color tone from the position lamp 8 and the headlights having a light source such as the HID bulb and the white LED light source.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle position lamp comprising:

a plurality of circuit boards each having a mounting surface and a rear surface;

a plurality of white LEDs each having an optical axis and a light-emitting direction, and each of the white LEDs mounted on a respective mounting surface of the circuit boards;

at least one first inner lens having a plurality of optical plates and at least one connecting plate connecting between adjacent optical plates, the plurality of optical plates each having an outer surface, an inner surface, and a diffusing lens having an optical axis, the at least one connecting plate having an outer surface and an inner surface, the outer surface of the at least one connecting plate located toward the outer surface of one of the adjacent optical plates and exposing the diffusing lens from the one of the adjacent optical plates in a direction toward the outer surface of the at least one connecting plate, the inner surface of the at least one connecting plate located toward the inner surface of an other one of the adjacent optical plates and exposing the diffusing lens from the other one of the adjacent optical plates in a direction toward the inner surface of the at least one connecting plate, the inner surface of the at least one connecting plate located toward the inner surface of another one of the adjacent optical plates and exposing the diffusing lens from the another one of the adjacent optical plates in a direction toward the inner surface of the at least one connecting plate, and the inner surface of each of the optical plates being located adjacent the respective one of the mounting surfaces of the circuit boards so that the optical axis of the diffusing lens of each of the optical plates substantially corresponds to the optical axis of each of the white LEDs, wherein the optical axis of the diffusing lens of each of the optical plates of the at least one first inner lens is located on substantially the same virtual surface;

a second inner lens having an inner surface, an outer surface and a pair of edge portions, the second inner lens being located adjacent the at least one first inner lens so that the inner surface of the second inner lens faces both the diffusing lens of each of the optical plates of the at least one first inner lens and the outer surface of the at least one connecting plate of the at least one first inner lens, and the second inner lens intersecting with the optical axis of the diffusing lens of each of the optical plates of the at least one first inner lens, and the outer surface of the second inner lens including a plurality of linear prisms which extend along the substantially same virtual surface including the optical axis of the diffusing lens of each of the optical plates of the at least one first inner lens; and a housing located adjacent the plurality of circuit boards so as to cover the at least one first inner lens along with the second inner lens, and wherein the at least one first inner lens integrates the at least one connecting plate into the plurality of optical plates as a unitary package.

2. The vehicle position lamp according to claim 1, wherein the at least one connecting plate of the at least one first inner lens is configured to receive a part of light from the inner surface of the one of the adjacent optical plates.

3. The vehicle position lamp according to claim 2, wherein the inner surface of the at least one connecting plate of the at least one first inner lens includes a concave surface toward the outer surface of the at least one connecting plate of the at least one first inner lens.

4. The vehicle position lamp according to claim 2, wherein the inner surface of each of the optical plates of the at least one first inner lens includes a plurality of linear prisms which extend at least one of in a direction parallel to the substantially same virtual surface including the optical axis of the diffusing lens of each of the optical plates of the at least one first inner lens and in a direction perpendicular to the substantially same virtual surface.

5. The vehicle position lamp according to claim 2, wherein the mounting surface and the rear surface of each of the circuit boards include a metallic foil having a substantially same thermal expansion coefficient.

6. The vehicle position lamp according to claim 2, wherein the at least one connecting plate of the at least one first inner lens includes a plurality of connecting plates each having a length between the adjacent optical plates, wherein the length of each of the connecting plates is configured to become gradually shorter in the light-emitting direction of each of the white LEDs.

7. The vehicle position lamp according to claim 2, further comprising:

at least two stays adjacent a respective one of the edge portions of the second inner lens, wherein the at least one first inner lens is attached to the second inner lens using the at least two stays.

8. A vehicle headlight including the vehicle position lamp according to claim 2, comprising:

a housing having an opening, and the opening including an edge portion;

an outer lens having an edge portion located adjacent the second inner lens of the vehicle position lamp, and the edge portion of the outer lens located adjacent the edge portion of the opening of the housing;

a lamp room between the housing and the outer lens, and the lamp room including the vehicle position lamp so that the second inner lens of the vehicle position lamp faces the outer lens; and at least one of a low beam headlight having a low beam light source and a light-emitting direction, a high beam headlight having a high beam light source and a light-emitting direction and a turn signal lamp having a light-emitting direction located in the lamp room along with the vehicle position lamp, wherein each of the light-emitting directions of the low beam headlight, the high beam headlight and the turn signal lamp is directed toward the outer lens.

9. The vehicle headlight according to claim 8, wherein each of the low beam light source of the low beam headlight and the high beam light source of the high beam headlight is at least one of an HID bulb and a white LED light source.

10. The vehicle headlight according to 8, wherein the at least one connecting plate of the at least one first inner lens includes a plurality of connecting plates each having a length between the adjacent optical plates, wherein the length of each of the connecting plates is configured to become gradually shorter in the light-emitting direction of each of the white LEDs.

11. The vehicle headlight according to claim 8, wherein the inner surface of each of the optical plates of the at least one first inner lens includes a plurality of linear prisms which extend at least one of in a direction parallel to the substantially same virtual surface including the optical axis of the diffusing lens of each of the optical plates of the at least one first inner lens and in a direction perpendicular to the substantially same virtual surface.

12. The vehicle position lamp according to claim 1, wherein the inner surface of each of the optical plates of the at least one first inner lens includes a plurality of linear prisms which extend at least one of in a direction parallel to the substantially same virtual surface including the optical axis of the diffusing lens of each of the optical plates of the at least one first inner lens and in a direction perpendicular to the substantially same virtual surface.

13. The vehicle position lamp according to claim 1, wherein the mounting surface and the rear surface of each of the circuit boards include a metallic foil having a substantially same thermal expansion coefficient.

14. The vehicle position lamp according to claim 1, wherein the at least one connecting plate of the at least one first inner lens includes a plurality of connecting plates each having a length between the adjacent optical plates, wherein the length of each of the connecting plates is configured to become gradually shorter in the light-emitting direction of each of the white LEDs.

15. The vehicle position lamp according to claim 1, further comprising:

at least one fixing seat located adjacent the inner surface of each of the optical plates of the at least one first inner lens, wherein the respective one of the circuit boards is attached to the at least one fixing seat.

16. The vehicle position lamp according to claim 1, further comprising:

at least two stays adjacent a respective one of the edge portions of the second inner lens, wherein the at least one first inner lens is attached to the second inner lens using the at least two stays.

17. A vehicle headlight including the vehicle position lamp according to claim 1, comprising:

a housing having an opening, and the opening including an edge portion;

an outer lens having an edge portion located adjacent the second inner lens of the vehicle position lamp, and the edge portion of the outer lens located adjacent the edge portion of the opening of the housing;

a lamp room between the housing and the outer lens, and the lamp room including the vehicle position lamp so that the second inner lens of the vehicle position lamp faces the outer lens; and at least one of a low beam headlight having a low beam light source and a light-emitting direction, a high beam headlight having a high beam light source and a light-emitting direction and a turn signal lamp having a light-emitting direction located in the lamp room along with the vehicle position lamp, wherein each of the light-emitting directions of the low beam headlight, the high beam headlight and the turn signal lamp is directed toward the outer lens.

18. The vehicle headlight according to claim 17, wherein each of the low beam light source of the low beam headlight and the high beam light source of the high beam headlight is at least one of an HID bulb and a white LED light source.

19. The vehicle headlight according to 17, wherein the at least one connecting plate of the at least one first inner lens includes a plurality of connecting plates each having a length between the adjacent optical plates, wherein the length of each of the connecting plates is configured to become gradually shorter in the light-emitting direction of each of the white LEDs.

20. The vehicle headlight according to claim 17, wherein the inner surface of each of the optical plates of the at least one first inner lens includes a plurality of linear prisms which extend at least one of in a direction parallel to the substantially same virtual surface including the optical axis of the diffusing lens of each of the optical plates of the at least one first inner lens and in a direction perpendicular to the substantially same virtual surface.

* * * * *